United States Patent [19]

Hulit et al.

[11] 4,309,246

[45] Jan. 5, 1982

[54] PAPERMAKING APPARATUS AND METHOD

[75] Inventors: David D. Hulit, Camas; Horace Hamby, III; Ronald E. Hostetler, both of Vancouver, all of Wash.

[73] Assignee: Crown Zellerbach Corporation, San Francisco, Calif.

[21] Appl. No.: 933,203

[22] Filed: Aug. 14, 1978

Related U.S. Application Data

[63] Continuation of Ser. No. 808,229, Jun. 20, 1977, abandoned.

[51] Int. Cl.[3] ..... D21H 5/24

[52] U.S. Cl. ..... 162/113; 162/117; 162/205; 162/206

[58] Field of Search ..... 162/111, 113, 117, 206, 162/267, 205, 281, 290, 305, 359, 362, 129; 264/283, 284

[56] References Cited

U.S. PATENT DOCUMENTS

| | | | |
|---|---|---|---|
| 2,537,129 | 1/1951 | Goodwillie | 162/290 |
| 3,014,832 | 12/1961 | Donnelly | 162/111 |
| 3,230,136 | 1/1966 | Krake | 162/111 |
| 3,301,746 | 1/1967 | Sanford et al. | 162/113 |
| 3,629,056 | 12/1971 | Forrest | 162/305 |
| 3,905,863 | 9/1975 | Ayers | 162/113 |
| 3,981,084 | 9/1976 | Sobota | 162/359 |

*Primary Examiner*—Peter Chin
*Attorney, Agent, or Firm*—Thomas R. Lampe

[57] ABSTRACT

A bulky, soft and absorbent creped paper web is manufactured by supporting an uncompacted wet web of principally lignocellulosic fibers on an imprinting fabric having compaction elements, for example knuckles formed at the warp and weft crossover points of the filaments of an open mesh fabric. The imprinting fabric has a surface void volume of from about 15 cc/m$^2$ to about 250 cc/m$^2$, preferably from about 40 cc/m$^2$ to about 150 cc/m$^2$, and a compaction element contact area constituting from about 5% to about 50%, preferably from about 20% to about 35%, of the total surface of the imprinting fabric. The web is selectively mechanically dewatered or pre-dried by passing the web through a first compression nip formed between the imprinting fabric and a dewatering felt at a pressure in a range from about 20 pli to about 600 pli so that significant compacting of the web occurs in the vicinity of the compaction elements. The selectively mechanically dewatered or pre-dried web is removed from the imprinting fabric after it passes the first compression nip and the web is then finally dried. According to a preferred embodiment, web removal is accomplished by applying the pre-dried web to a creping surface at a second compression nip formed between the creping surface and the imprinting fabric. The web remains essentially undisturbed on the imprinting fabric as it is transported between the first and second compression nips so that the fabric compaction elements contact essentially the same portions of the web at the second compression nip that were contacted at the first compression nip. The web is then thermally dried, creped and removed from the creping surface.

9 Claims, 5 Drawing Figures

PAPERMAKING APPARATUS AND METHOD

This is a continuation, of application Ser. No. 808,229, filed June 20, 1977, abandoned.

BACKGROUND OF THE INVENTION

This invention relates to manufacture of a bulky, soft and absorbent paper web and is particularly applicable to the manufacture of sanitary paper and similar products, such as tissue, toweling and similar papers wherein these characteristics are particularly desirable.

Conventional papermaking techniques are generally unsatisfactory for the manufacture of bulky, soft and absorbent paper webs since they utilize prior to drying one or more pressing operations on substantially the entire surface of the paper web to expel excess water, smooth the sheet and provide strength thereto. While overall pressing operations are probably the most efficient methods of dewatering and achieve requisite tensile strength in a paper sheet by bringing the individual fibers of the web into close physical proximity, this operating efficiency and increase in product strength are more than counter-balanced by destroying the desirable combination of softness, absorbency and bulk desirable in sanitary and similar products.

A number of approaches have been developed in an attempt to provide a soft, bulky and absorbent sheet which has desirable strength characteristics. One approach is set forth in U.S. Pat. No. 3,301,746 which discloses a process wherein a paper web is formed with essentially no pressing, is thermally pre-dried, and is then heavily compacted in a knuckle pattern against a dryer drum while the web is still wet enough to allow increase in bonding by compaction.

Pre-drying of the web shown in U.S. Pat. No. 3,301,746 is accomplished by means of a through-drying system in which hot gases are passed through the web prior to imprinting of the knuckle fabric at the dryer drum. Water removal using through-dryers of the type utilized in the U.S. Pat. No. 3,301,746 process is very energy intensive and such dryers are constructed and operated at considerable expense.

Other systems have been developed for the manufacture of an absorbent, soft, bulky web. One such arrangement is disclosed in U.S. Pat. No. 3,812,000 directed to a process wherein an elastomeric bonding material is mixed with lignocellulosic fibers and the web formed thereby is dried without mechanical compression until it is at least 80% dry. The various techniques taught for drying the web are radiant heat lamps, tunnel dryers, or transpiration dryers (through-dryers) wherein air, preferably heated, is used to pre-dry the web. Again, use of such pre-drying techniques results in a considerable expenditure of energy with consequent high expense.

Yet another technique is taught in U.S. Pat. No. 3,821,068. According to the technique taught in this patent a creped web is formed by deposition from an aqueous slurry of principally lignocellulosic fibers and dried to at least 80% fiber consistency or dryness without being subjected to mechanical compression of the web to substantially reduce formation of papermaking bonds which would form upon compression of the web while wet. A creping adhesive is applied to one surface of the web and the web is adhered to a creping surface with the web being dried on the creping surface to about 95% dryness level before removal with a creping blade. Pre-drying is again effected thermally through the use of radiant heat lamps, tunnel dryers, or preferably transpiration dryers. As stated above, such pre-drying arrangements are energy intensive and expensive.

All of the above-described methods operate on a common assumption, that is, that pre-drying or dewatering without mechanical compression is necessary to produce a product having adequate strength and yet having the desirable characteristics associated with sanitary papers and the like of softness, bulk and absorbency. Since mechanical compression is avoided in the pre-drying stage various expensive pre-drying substitutes must be adopted to preliminarily dewater the sheet without compacting same. It will be appreciated that such through-drying techniques are wasteful in that they use up inordinate amounts of diminishing natural resources such as natural gas.

It is therefore an object of the present invention to provide a process for manufacturing a soft, bulky and absorbent paper sheet having adequate strength and of a quality at least comparable to the products produced by the above-described prior art systems without the use of thermal pre-drying techniques. In view of the teachings of the prior art, it is very surprising to learn that a sheet of the type desired can be produced through the use of a mechanical dewatering or pre-drying step. It is perhaps even more surprising to learn that the process of this invention may be used to produce a web whose bulk is actually enhanced by passing it through a compression nip of a specific nature.

SUMMARY OF THE INVENTION

According to the present invention a method is provided for the manufacture of a soft, bulky and absorbent paper web having adequate strength for use as sanitary paper and the like. According to the method, an uncompacted wet web is attached to an imprinting fabric having compaction elements formed for example by knuckles at the warp and weft crossover points of the filaments of an open mesh fabric. The imprinting fabric is characterized by having a surface void volume of from about 15 cubic centimeters per meter squared ($cc/m^2$) to about 250 $cc/m^2$, preferably from about 40 $cc/m^2$ to about 150 $cc/m^2$, and a knuckle contact area of from about 5% to about 50%, and preferably from about 20% to about 35%. The paper web is selectively mechanically dewatered by passing the wet web through a first compression nip formed between the imprinting fabric and a conventional paper-maker's dewatering wet felt so that significant compacting of the web occurs only in the vicinity of the compaction elements comprised of the knuckles. Preferably, the selectively mechanically dewatered pre-dried web is retained on the imprinting fabric after it passes the first compression nip and is thereafter applied to a heated creping surface at a second compression nip formed between the creping surface and the imprinting fabric. The web remains essentially undisturbed on the imprinting fabric as it is transported between the compression nips so that the fabric compaction elements contact essentially the same portions of the web at the second compression nip that were contacted at the first compression nip. The web is then thermally dried, creped and removed from the creping surface.

DESCRIPTION OF THE PREFERRED EMBODIMENTS

Figure 1:
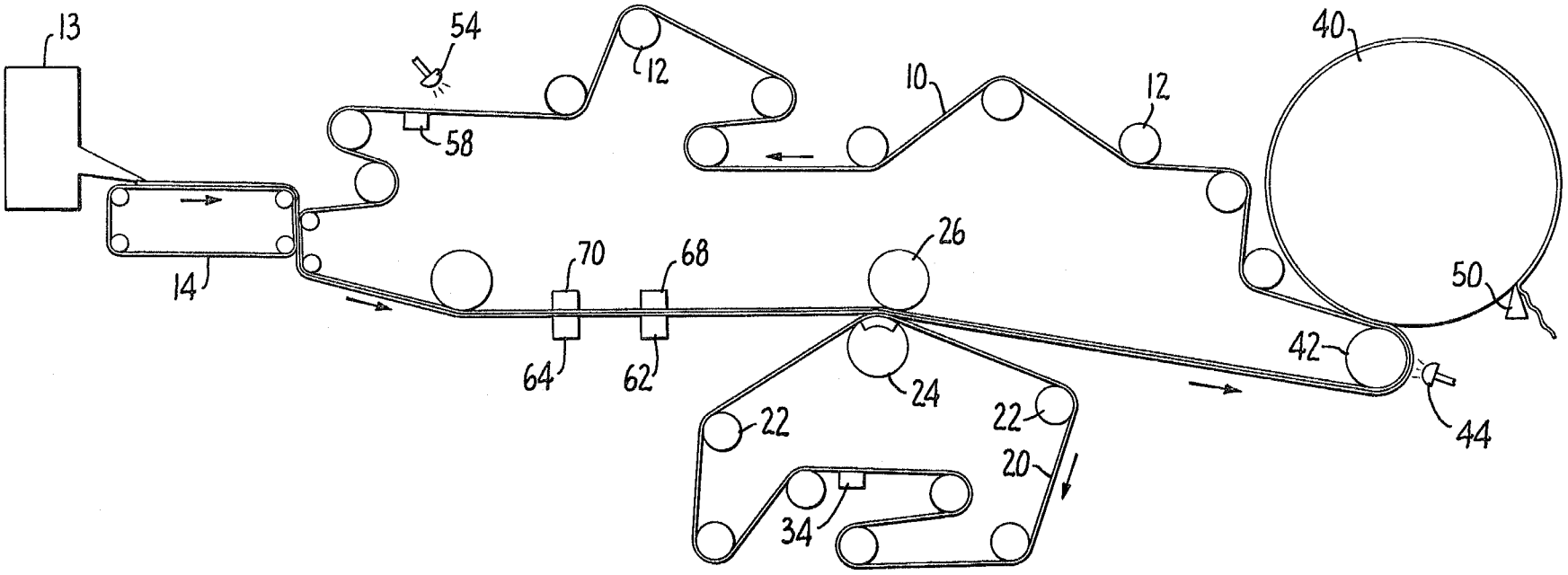
FIG. 1 is a schematic side view of a preferred form of apparatus for carrying out the method of the invention.

Referring now to FIG. 1 a papermaking machine is illustrated which may be utilized to manufacture a strong, soft, bulky and absorbent sheet according to the process of the present invention. The machine includes an imprinting fabric 10 supported by support rolls 12 in the form of a continuous loop. Fabric 10 is adapted to pick up an essentially uncompacted paper web from any sheet-forming device such as headbox 13 and fourdrinier wire 14. The precise mechanism for delivering the slurry to the imprinting fabric 10 is a matter of choice. It is important, however, that the web be essentially uncompacted prior to placement on the fabric.

The imprinting fabric 10 continuously moves in the direction of the arrows. The fabric has certain characteristics that must be employed when practicing the process of the present invention. The imprinting fabric must incorporate means defining compaction elements which compact the paper web supported by the imprinting fabric during the selective mechanically predrying or dewatering step that will be described in detail below. The compaction elements may for example be defined by the knuckles formed at the warp and weft crossover points of the filaments of an open mesh fabric. The imprinting fabric has a surface void volume of from about 15 cc/m$^2$ to about 250 cc/m$^2$, and preferably from about 40 cc/m$^2$ to about 150 cc/m$^2$, with the compaction element area of the imprinting fabric constituting between about 5% and about 50%, and preferably from about 20% to about 35%, of the total web supporting surface area of the fabric.

The surface void volume of an imprinting fabric is defined as the fabric void space occupied by a plastic sheet of specified composition when pressed into the imprinting fabric from the normal web contacting side thereof at a temperature of 212° F. for 5 minutes at a uniform pressure of 50 psi. The plastic sheet is a random copolymer of vinyl chloride and vinyl acetate wherein the vinyl chloride content is 83.2% and the vinyl acetate content is 16.8%, and contains 0.92% plasticizer. The copolymer has a Dilute Solution Viscosity logarithmic viscosity number of 0.639 (ASTM D 1243-66).

The first step is to determine the total void space defined by an imprinting fabric between the outer surfaces thereof. To determine this figure, six 1×3-inch specimens of fabric are cut with the 3-inch dimension corresponding to the warp direction of the fabric. Individual specimens are weighed and recorded to the nearest 0.1 milligram. Three of the specimens are separately sandwiched between pairs of glass slides with a plastic sheet of the aforedescribed composition, said sheet being positioned on the normal paper web contacting surface of the fabric. The sandwiched plastic sheet is three inches long and 1 inch wide to correspond to the fabric dimensions and has a caliper of 21.6 mils. The sandwiches are then pressed for 5 minutes at 212° F. and 50 psi. After pressing, the glass slide in contact with the fabric is removed and the three remaining sandwiches (glass slide–plastic sheet–fabric) are separately clamped by means of binder clips for subsequent processing.

Figure 5:
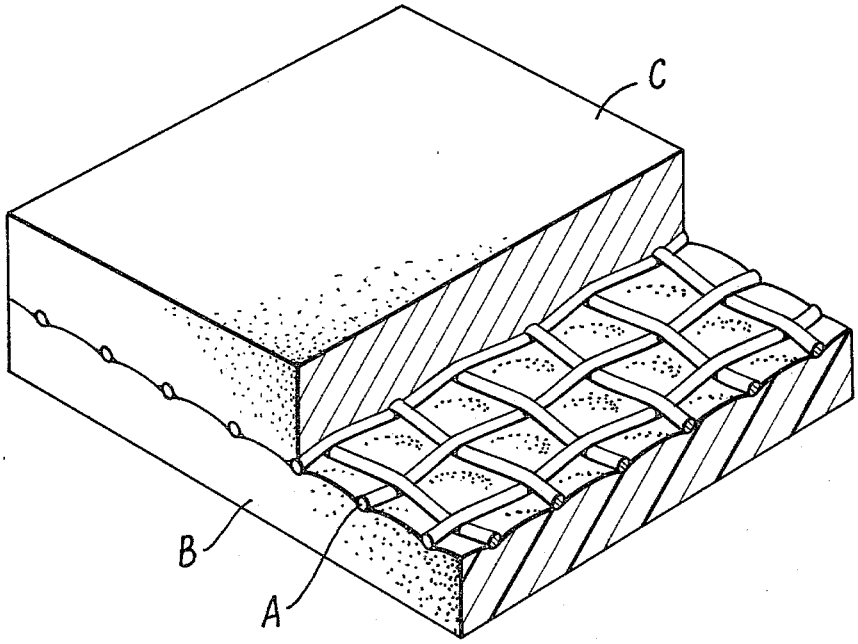
FIG. 5 is a schematic illustration of the technique employed to establish the surface void volume of an imprinting fabric.

The three sandwiches are now immersed in molten paraffin wax maintained in a suitable container at 160° F. The three pieces of separate fabric are also so immersed. With the six specimens (three sandwiches and three pieces of fabric) still immersed, the wax container is transferred to a vacuum oven and held under vacuum to remove entrapped air from the specimens. The specimens are individually removed from the hot wax and placed on separate glass 1×3-inch slides. Additional molten wax is added to overflow the top surface of each specimen and a second glass slide pressed on the surface to force out excess wax. The binder clips are of course removed from the sandwich specimens prior to this step. The wax-filled specimens are then chilled to allow the glass slides to be removed from the specimens without disturbing the wax. One suitable approach for effecting chilling is to chill the specimens on an aluminum block in a dry-ice-acetone bath. FIG. 5 shows a fabric A (partially broken away for illustration) having impressed therein from the normal web contacting side thereof a plastic sheet B of the specified type. On the other side wax C fills the rest of the void volume of the fabric. It will be appreciated that the volume of the fabric occupied by the plastic sheet is the surface void volume.

The next step is to remove excess wax from the specimens by scraping same with a suitable tool. In the case of the fabric specimens, the wax is scraped down to the knuckle level of both surfaces of the fabric and from the edges. In the case of the sandwich specimens, the wax is scraped from the specimen edges and down to the knuckle level of the side of the fabric not in engagement with the plastic sheet.

To determine the surface void volume, the total volume of wax remaining in the three separate fabric specimens is first determined. This is done by weighing the three waxed fabric specimens to the nearest 0.1 milligram. The total volume (Total Void Volume) occupied by the wax in the fabric specimens (expressed in cubic centimeters per square meter) is calculated according to the following formula:

$$\text{Total Void Volume} = \frac{(\text{Weight of waxed specimen, g}) - (\text{Initial fabric weight, g})}{(3\ \text{in}^2)\,(0.767\ \text{g/cc})\,(6.452 \times 10^{-4}\ \text{m}^2/\text{in}^2)}.$$

To determine the volume of wax remaining in the three sandwich specimens (Partial Void Volume) the plastic sheet is first removed. The remaining fabric and wax are then weighed. Partial Void Volume is calculated according to the following formula:

$$\text{Partial Void Volume} = \frac{\text{Weight of waxed specimen, g} - \text{Initial fabric weight, g}}{(3\ \text{in}^2)\,(0.767\ \text{g/cc})\,(6.452 \times 10^{-4}\ \text{m}^2/\text{in}^2)}$$

$$\text{Surface Void Volume (cc/m}^2) = \text{Total Void Volume} - \text{Partial Void Volume}$$

The imprinting fabric transports the uncompacted web into a nip defined by the imprinting fabric 10 and a dewatering felt 20. Here the selective mechanical dewatering or pre-drying step of the present invention takes place. The dewatering felt 20 is of a closed loop construction being looped about a plurality of spaced support rolls 22 and a vacuum roll 24. Positioned in opposed relationship to the vacuum roll 24 is a compression roll 26, formed of hard rubber or any other suitable material, which together with the vacuum roll 24 serves to form a compression nip between the imprinting fabric 10 and the dewatering felt 20. Rolls 24 and 26 are loaded to a pressure in a range from about 20 pli to about 600 pli and preferably from about 50 pli to about 250 pli. The dewatering felt 20 may be of any conventional papermaker's dewatering wet felt construction. An example of a felt which has been found suitable for practicing the present invention is an Albany medium Durasorb felt manufactured by the Albany Felt Company and comprised of 51% wool and 49% synthetic material. The referenced felt is a medium class needled-felt with a satin weave finish on the sheet surface and having a permeability (expressed in $CFM/Ft^2/\frac{1}{2}''$ $H_2O$) of 45.

Figure 2:
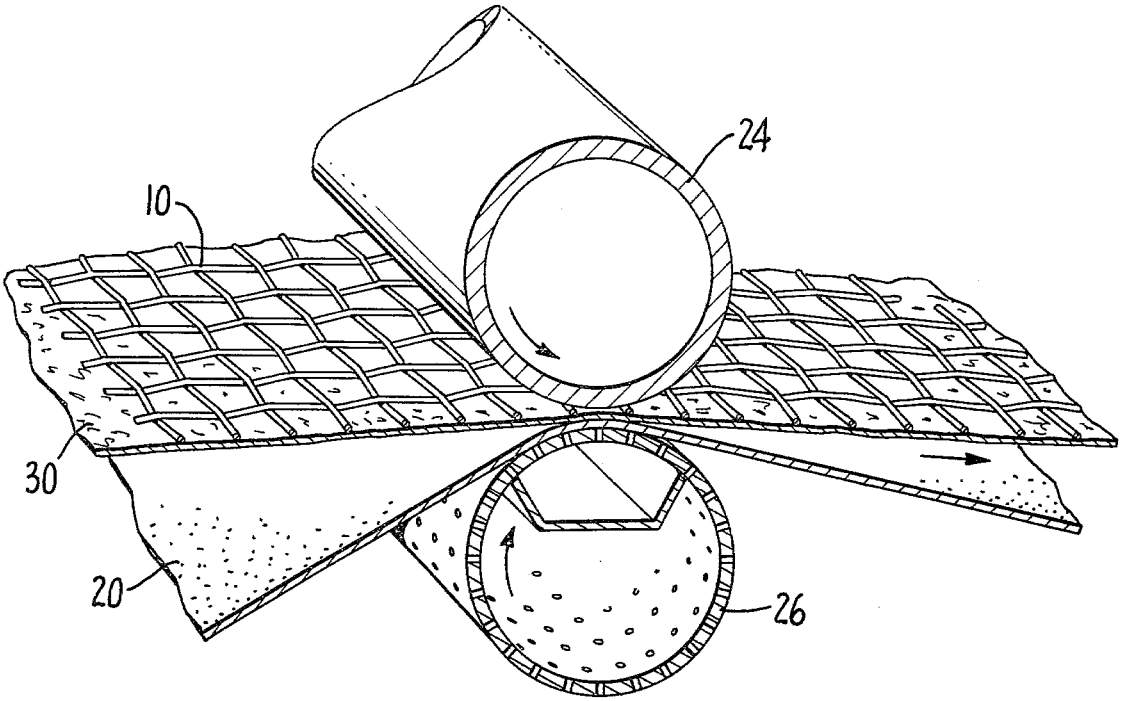
FIG. 2 is a view showing details of the first compression nip.

FIG. 2 shows the cooperative relationship between the imprinting fabric 10 and the dewatering felt 20 at the compression nip formed between rolls 24 and 26. The paper web passing between the nip is designated by reference numeral 30. As the imprinting fabric 10 and the web 30 progress along in the direction of the arrow, the paper web comes into contact with the felt 20 and is progressively compressed as the nip distance decreases. In addition to absorbing water from the web, the felt 20 serves to force fibers of the web into the void spaces formed between the warp and weft strands of the relatively open mesh imprinting fabric 10, with the portions of the paper web not lying in the immediate vicinity of the compaction elements formed by the knuckles at the warp and weft crossover points of the imprinting fabric remaining relatively uncompacted. Although a plain press roll or a grooved press roll may be satisfactory for some applications, it is preferred that the roll 24 be a vacuum roll that applies a vacuum to the underside of the dewatering felt 20 to assist in removal of water from the paper web in the well known manner. It is believed that because of the vacuum thus created, ambient air tends to flow through the imprinting fabric 10, through the paper web and thence into the dewatering felt, thus minimizing rewetting of the paper web as it is passing out of the nip.

Referring once again to FIG. 1, the felt 20, which moves at the same lineal speed as the imprinting fabric 10, moves in the direction of the arrows along the path defined by the support rolls 22. The felt passes adjacent to one or more dewatering devices such as vacuum box 34 to remove from the felt the water that has been absorbed from the paper web 30. Before entering the nip defined by rolls 24 and 26, the paper web has a fiber consistency in the range from about 8% to about 25% and after leaving the compression nip the paper web has a consistency of from about 20% to about 38%.

It should be noted that the paper web 30 remains on the imprinting fabric 10 after leaving the aforedescribed nip which is utilized to selectively mechanically dewater or pre-dry the web. According to conventional papermaking theory, the web should follow the wet felt at the nip exit. This unexpected result is believed to be caused by two factors; first, adhesion or coadhesion by water from the wet paper web to the non-absorbent monofilament fabric and, to a secondary degree, mechanical entanglement of the web fibers in the monofilament fabric. In the nip the water exposed to the needled side of the felt is wicked away by capillary action in the vertical needled fibers assisted by the vacuum in the suction press, whereas the water on the monofilament fabric side forms a tight adhesive or cohesive bond with the web and the non-absorbent monofilament fabric. The web and the direction it travels are dictated by the water balance at its surface and the surface it contacts and due to the fact that the web has been impressed into the voids defined by the fabric filaments, there is actually more surface contact area between the web and the monofilament fabric than there is between the web and the felt.

From the rollers 24 and 26 paper web 30 is conveyed to a movable creping surface such as the surface of Yankee dryer 40. The paper web is pressed into engagement with Yankee dryer 40 by means of a compression roll 42 about which imprinting fabric 10 is looped. The paper web remains essentially undisturbed on the imprinting fabric as it is transported between the first compression nip formed between rollers 24 and 26 and the second compression nip formed between roll 42 and Yankee dryer 40 so that the fabric compaction elements contact essentially the same portions of the web at the second compression nip that were contacted at the first compression nip. The pressure at the second compression nip is in a range of from about 20 pli to about 600 pli, and preferably from about 50 pli to about 250 pli.

It has been found that an adhesive will assist in the transfer of the paper web to the creping surface of the Yankee and in FIG. 1, a spary nozzle 44 is illustrated schematically as one means by which adhesive application may take place. In this embodiment the adhesive is sprayed onto the surface of the paper web just prior to the web and imprinting fabric passing between roll 42 and Yankee dryer 40. In a configuration of this type a suitable adhesive spray was found to be a 0.25% solution of carboxymethyl cellulose (CMC). After the web 30 is dried on the surface of the Yankee dryer, preferably to a dryness range of from about 92% to about 98% solids, it is creped off the Yankee dryer by a creping blade 50. The web is then converted in the usual fashion. After the paper web leaves the imprinting fabric the fabric is preferably cleaned as by means of a water spray nozzle or steam jet 54, a vacuum box 58 disposed in association therewith, or by any suitable conventional fabric cleaning equipment.

Figure 3:
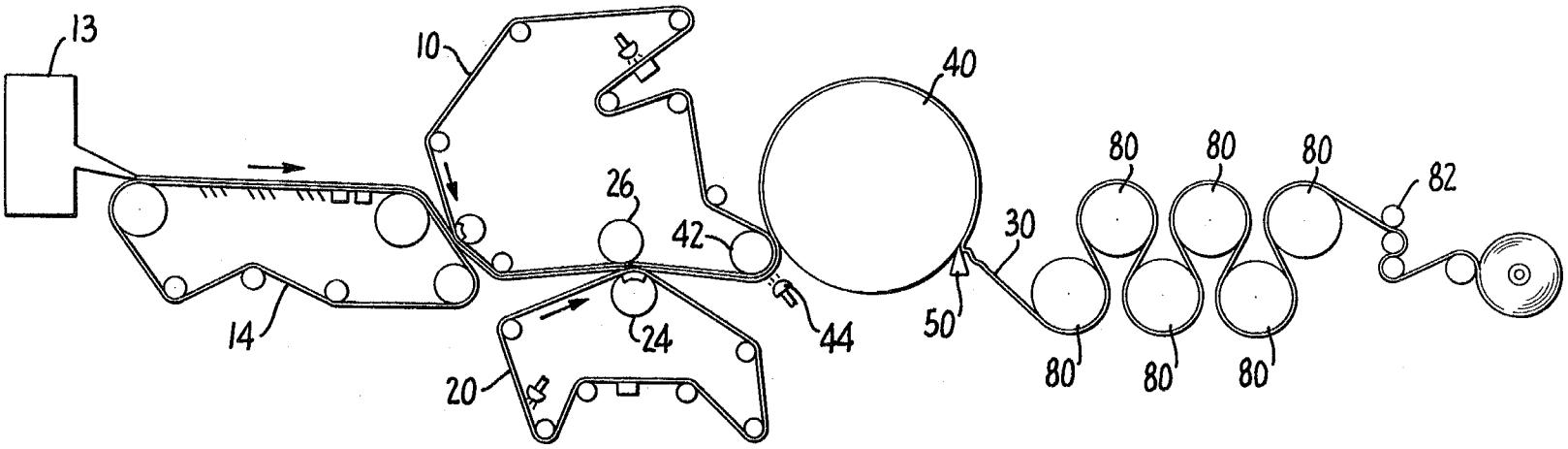
FIG. 3 is a schematic side view of another form of apparatus for carrying out the method of the invention.

Referring now to FIG. 3, another paper machine configuration for practicing the method of the present invention is illustrated, this embodiment being particularly adapted to the manufacture of semicrepe tissue, toweling, filter papers and similar products. This configuration utilizes many elements and structural interrelationships in common with the configuration of FIG. 1 and such common elements have been designated by the same reference numerals. Specifically, the configuration of FIG. 3 includes a headbox 13 which delivers a slurry to a fourdrinier wire 14. The wet web formed on the wire 14 is transferred without significant mechanical compression to a knuckled imprinting fabric 10. Imprinting fabric 10 delivers the web to a nip defined by the imprinting fabric 10 and a dewatering felt 20, said web being selectively mechanically compressed between imprinting fabric 10 and felt 20 by vacuum roll 24 and compression roll 26 as was the case with respect to the FIG. 1 embodiment. After passing through the nip the web is retained on the imprinting fabric and transported thereby to a Yankee dryer 40. The paper web remains essentially undisturbed on the imprinting fabric as it is transported between the first compression nip formed between rollers 24 and 26 and the second compression nip formed by compression roll 42 and the Yankee dryer. A spray nozzle 44 is utilized to spray adhesive onto the paper web to assist in transfer of the web to the Yankee dryer. The Yankee dryer then dries the web to a dryness in a range of from about 40% to about 70% solids whereupon the web is creped by means of a creping blade 50. The partially dried web then proceeds along a path in engagement with a plurality of rotating dryer drums 80 which serve to finally dry the web. Alternatively, final drying could be affected by a transpiration dryer. The web is then passed through a calender stack 82 and wound unto a parent roll for subsequent conversion.

Figure 4:
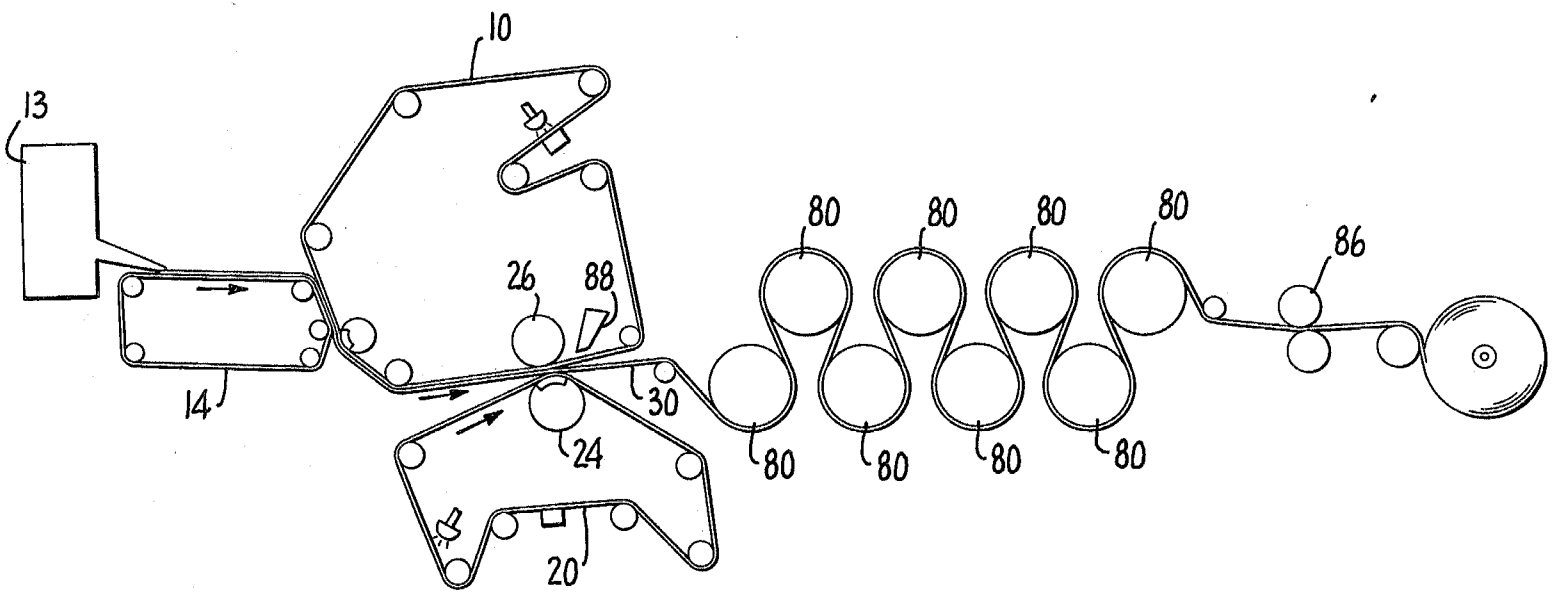
FIG. 4 is a schematic side view of yet another form of apparatus for carrying out the method of the invention.

FIG. 4 illustrates yet another paper machine configuration suitable for practicing the present invention. Following the same reference numeral conventions employed with respect to the embodiments of FIGS. 1 and 3, the FIG. 4 configuration includes a headbox 13 which delivers a wet paper web 30 to a fourdrinier wire 14. The web 30 is transferred in an essentially uncompacted state to a knuckled imprinting fabric 10. The web is then passed through a compression nip defined by imprinting fabric 10 and dewatering felt 20, said imprinting fabric and felt being acted upon by vacuum roll 24 and compression roll 26 in the manner previously described with respect to other embodiments of this invention. After the web 30 is selectively mechanically compressed between the knuckled imprinting fabric and the felt it is separated from both the felt and the imprinting fabric and is transported independently to a plurality of dryer drums 80 and thence to a calender 86. Again, final drying could be affected by a transpiration dryer rather than dryer drums. The web is then rolled into a jumbo or parent roll for subsequent conversion. After passing through the selective mechanical compression nip the web 30 would stay with the imprinting fabric 10 in the manner previously described with respect to the FIG. 1 and FIG. 3 embodiments unless some means is employed to separate the web and fabric from one another. In the present embodiment this separation is facilitated by employing an air or steam jet 88 which impinges against the non-web-supporting side of imprinting fabric 10 along the full width thereof and serves to lift the paper web therefrom. It has been found that the consistency of the paper web 30 must be at least about 20% for the web to maintain its intergrity after removal from the imprinting fabric.

As noted above, the paper web manufactured in accordance with the teachings of the present invention has desirable physical characteristics that one would normally associate in the prior art only with thermally pre-dryed webs, as exemplified in U.S. Pat. No. 3,301,746, for example. The following examples illustrate the sheet materials produced by the process of the present invention and prior art thermally predryed materials. It is understood that the examples are intended to be illustrative and not limiting, and the scope of the invention is only to be construed by the scope of the appended claims.

In the following examples the basis weight of a given sheet is determined by TAPPI test No. T-410 and is expressed in pounds per 3,000 square feet. Sheet bulk softness is expressed as HOM/(caliper)$^2 \times 10^5$. The HOM (Handle-O-Meter) test is described in TAPPI T498. The bulk softness (reciprocal of stiffness) of a given sheet is calculated by dividing the HOM value by the square of the caliper of a single sheet being tested and multiplying the quotient thereof by $10^5$.

Sheet bulk is a function of sheet density. In the following examples the density of a given sheet is calculated by determining the lobb caliper of the sheet and dividing same by the basis weight of the sheet. Lobb caliper is determined by placing 24 sheets between a jaw of opposed matching cylinders four inches in diameter, under a load of 1.35 pounds per square inch, and measuring the thickness of the stacked sheets to 0.001 of an inch. The caliper of a single sheet is then determined by dividing the lobb caliper reading by 24.

EXAMPLE 1

As an illustration of the prior art, a commercial bathroom tissue made using the thermal pre-dry process described in the U.S. Pat. No. 3,301,746, was tested and possessed the following general properties:

| | |
|---|---|
| Basis Weight, pounds/3,000 sq. ft. | 18.1 |
| Lobb Caliper, mils/24 sheets | 177 |
| Lobb Density, g/cc | 0.156 |
| Tensile, oz/in(MD) | 7.6 |
| Tensile, oz/in(CD) | 5.0 |
| Rate Water Absorbency, sec/0.1 cc | 1.9 |
| HOM/(caliper)$^2 \times 10^5$ | 0.75 |

EXAMPLE 2

As an illustration of the present invention, the web was initially formed from an aqueous paper fiber slurry on a vacuum cylinder former. The wet web was transferred to a knuckled monofilament imprinting fabric having 36×29 meshes per inch and formed from filaments having a diameter of 0.0016 in. The web supporting surface of the fabric had a knuckle pattern defined by the warp and weft crossover points of the filaments. The knuckle imprint area of the imprinting fabric constituted 20% of the total fabric surface area and the fabric had a surface void volume of 59 cc/m$^2$.

The web was transported from the former to a first compression nip formed between the imprinting fabric and a dewatering felt. The papermakers felt was an Albany medium Durasorb, style XY8253 felt. The dewatering felt was entrained around a vacuum roll and a vacuum of 10 in Hg was applied to the dewatering felt at the surface thereof opposing the surface in engagement with the paper web. The pressure at the compression nip was 130 pli. The fiber consistency of the web prior to entering the compression nip was 25% and after leaving same was 31%. From the first compression nip the selectively dewatered paper web was transported to a Yankee dryer, the web remaining essentially undisturbed on the imprinting fabric so that the fabric knuckles contacted essentially the same portions of the web when the web was applied to the Yankee dryer as those contacted at the first compression nip. The imprinting fabric was entrained about a roll which compressed the web against the Yankee surface by means of the imprinting fabric. The pressure at the second compression nip located at the Yankee dryer was 140 pli. To assist in the transfer of the selectively mechanically dewatered web to the Yankee surface an adhesive solution of 0.5% CMC and 0.0025 calcium stearate was sprayed onto the web just prior to transfer at a rate of 6.77 Kg/1000 m$^2$. The sheet was thermally dried and then creped from the Yankee dryer. The creped paper had the following general properties:

| | |
|---|---|
| Basis Weight, pounds/3,000 sq. ft. | 18.1 |
| Lobb Caliper, mils/24 sheets | 178 |
| Lobb Density, g/cc | 0.156 |
| Tensile, oz/in(MD) | 5.84 |
| Tensile, oz/in(CD) | 5.06 |
| Rate Water Absorbency, sec/0.1 cc | 1.91 |
| HOM/(caliper)$^2 \times 10^5$ | 0.76 |

It may be seen from the above that a paper sheet having desirable characteristics of strength, softness, bulk and absorbency may, contrary to prior expectation, be manufactured through utilization of a selectively mechanically pre-drying technique which is much cheaper in both cost of construction and operation than conventional thermal pre-drying techniques. It will be appreciated that the fabric to felt pre-drying arrangement disclosed may be utilized in conjunction with other dewatering techniques which avoid significant compression of the paper web in other than the knuckle imprint areas. For example, referring to FIG. 1, air or steam jets such as those indicated schematically and identified by reference numerals 62 and 64 may be employed to assist in the preliminary dewatering of the paper web. Vacuum boxes 68 and 70 may be used to remove excess water dislodged from the paper web by the jets 62 and 64. Similar arrangements could be employed in association with the imprinting fabric 10 downstream from the first compression nip. In addition to assisting in the preliminary dewatering of the web, such jets, when employed upstream from the first compression nip, serve to partially entangle web fibers in the void spaces of the imprinting fabric. As previously noted, such entanglement is desirable to assist in the retention of the web on the imprinting fabric as it passes through the first compression nip.

We claim:

1. A method for manufacturing a bulky, soft and absorbent paper web comprising the steps of:

forming an uncompacted wet web of principally lignocellulosic fibers from an aqueous slurry;

delivering the uncompacted wet web to an open mesh imprinting fabric formed of woven filaments, the web supporting surface of the fabric having spaced compaction elements comprising web imprinting knuckles located at the warp and weft crossover points of the filaments and said fabric having a surface void volume of from about 15 cc/m$^2$ to about 250 cc/m$^2$;

forming a first compression nip between the open mesh imprinting fabric and a papermaker's dewatering felt by passing said fabric and felt between a pair of opposed rolls;

selectively mechanically pre-drying the paper web by passing the web through said first compression nip formed between the imprinting fabric and the papermaker's dewatering felt so that significant compaction of the web occurs at the imprinting fabric compaction elements over about 5% to about 50% of the web surface, said web having a fiber consistency in the range of from about 8% to about 25% prior to passing through said first compression nip and in the range of from about 20% to about 38% after passing through said first compression nip;

removing the felt from the selectively mechanically pre-dried web after said web passes through the first compression nip so that the web is retained solely on the imprinting fabric;

transferring the web directly to a drying surface from said open mesh imprinting fabric; and finally drying the selectively mechanically pre-dried web.

2. The method according to claim 1 wherein the surface void volume of said fabric is from about 40 cc/m$^2$ to about 150 cc/m$^2$.

3. The method according to claim 1 wherein said imprinting fabric has a compaction element contact area constituting from about 20% to about 35% of the total surface of the imprinting fabric whereby significant compaction of the web by the imprinting fabric occurs at said first compression nip over about 20% to about 35% of the web surface.

4. The method according to claim 1 wherein the selectively mechanically pre-dried web is transferred from the imprinting fabric before final drying thereof by applying the web to a heated creping surface at a second compression nip formed between the creping surface and said imprinting fabric, said web being retained on the imprinting fabric in an essentially undisturbed condition as it is transported between the first and second compression nips so that the fabric compaction elements contact essentially the same portions of the web at the second compression nip that were contacted at the first compression nip, and including the additional steps of thermally drying the web on the creping surface after its application thereto and creping and removing the web from the creping surface after it is thermally dried.

5. The method according to claim 1 wherein said opposed rolls are loaded to a pressure in the range from about 20 pli to about 600 pli.

6. The method according to claim 4 wherein said second compression nip is formed between a roll engaging the side of said imprinting fabric not in engagement with the paper web and said creping surface, said roll being loaded to a pressure in a range from about 20 pli to about 600 pli.

7. The method according to claim 1 wherein a vacuum is applied to the dewatering felt at the first compression nip at the side thereof not in engagement with the paper web.

8. The method according to claim 1 wherein the step of retaining the pre-dried web on the imprinting fabric is at least partially accomplished by entangling fibers of said web with the imprinting fabric.

9. The method according to claim 4 wherein said web is dried on said heated creping surface to a dryness in the range of from about 40% to about 70% solids and then creped therefrom.

* * * * *